US009856117B2

(12) United States Patent
Ottersland

(10) Patent No.: US 9,856,117 B2
(45) Date of Patent: Jan. 2, 2018

(54) LIFTING ARM ASSEMBLY AND METHOD OF CHANGING A HOLDER IN SAID LIFTING ARM ASSEMBLY

(71) Applicant: MHWIRTH AS, Kristiansand (NO)

(72) Inventor: Gjerulf Ottersland, Kristiansand (NO)

(73) Assignee: MHWIRTH AS, Kristiansand (NO)

( * ) Notice: Subject to any disclaimer, the term of this patent is extended or adjusted under 35 U.S.C. 154(b) by 0 days.

(21) Appl. No.: 14/896,667

(22) PCT Filed: Jun. 3, 2014

(86) PCT No.: PCT/IB2014/061906
§ 371 (c)(1),
(2) Date: Dec. 8, 2015

(87) PCT Pub. No.: WO2014/199260
PCT Pub. Date: Dec. 18, 2014

(65) Prior Publication Data

US 2016/0137461 A1 May 19, 2016

(30) Foreign Application Priority Data

Jun. 10, 2013 (NO) ..... 20130805

(51) Int. Cl.

| | |
|---|---|
| ***E21B 19/00*** | (2006.01) |
| ***B66C 1/22*** | (2006.01) |
| ***E21B 19/14*** | (2006.01) |
| ***E02F 3/36*** | (2006.01) |

(52) U.S. Cl.
CPC ..... *B66C 1/22* (2013.01); *E02F 3/3631* (2013.01); *E02F 3/3636* (2013.01); *E02F 3/3668* (2013.01); *E02F 3/3672* (2013.01); *E21B 19/14* (2013.01)

(58) Field of Classification Search
CPC . B66C 1/22; B66C 1/427; E21B 19/14; E21B 19/06; E21B 19/155; E21B 19/00; E21B 19/087; E21B 19/15; E21B 19/20; E21B 19/146; B25J 15/0028; B61B 13/02;
(Continued)

(56) References Cited

U.S. PATENT DOCUMENTS 3,112,830 A * 12/1963 Podlesak ..... B66C 13/18 294/106
3,461,928 A 8/1969 Siiro
3,929,235 A 12/1975 Howard et al.
(Continued)

FOREIGN PATENT DOCUMENTS

EP 0 171 368 A1 2/1986
WO WO 93/22535 A2 11/1993
(Continued)

*Primary Examiner* — Stephen A Vu
(74) *Attorney, Agent, or Firm* — Norman B. Thot

(57) ABSTRACT

A lifting arm assembly for lifting an elongate element includes a lifting arm comprising a complementary fastener and at least one fastening element, and a holder for at least one tool which comprises a first complementary fastening device. The holder is configured to be replaceable. The holder comprises a suspension device configured to fasten to the complementary fastener on the lifting arm, and at least one first receiving device configured to cooperate with the first complementary fastening device on the at least one tool.

18 Claims, 10 Drawing Sheets

(58) Field of Classification Search
CPC ..... B61B 5/02; E02F 3/3631; E02F 3/3636; E02F 3/3668; E02F 3/3672
See application file for complete search history.

(56) References Cited

U.S. PATENT DOCUMENTS

| | | | | |
|---|---|---|---|---|
| 3,937,515 | A | 2/1976 | Langowski | |
| 4,615,656 | A * | 10/1986 | Geraghty, Jr. | B66F 9/18 294/103.1 |
| 5,458,454 | A | 10/1995 | Sorokan | |
| 7,014,385 | B2 | 3/2006 | Lim et al. | |
| 7,677,279 | B2 | 3/2010 | Swinyard et al. | |
| 7,794,192 | B2 * | 9/2010 | Wright | E21B 19/14 414/22.65 |
| 8,235,104 | B1 | 8/2012 | Sigmar et al. | |
| 2007/0193750 | A1 | 8/2007 | Wright et al. | |
| 2010/0300778 | A1 | 12/2010 | Miyazaki et al. | |
| 2010/0308609 | A1 | 12/2010 | LaValley et al. | |
| 2011/0200412 | A1 | 8/2011 | Orgeron | |
| 2012/0297933 | A1 * | 11/2012 | Lavalley | E02F 3/965 81/57.34 |
| 2013/0045073 | A1 | 2/2013 | Bricker et al. | |

FOREIGN PATENT DOCUMENTS

| | | | |
|---|---|---|---|
| WO | WO2004/018829 | A1 | 3/2004 |
| WO | WO 2007/097698 | A1 | 8/2007 |
| WO | WO2009/055590 | A2 | 4/2009 |
| WO | WO2012/148286 | A1 | 11/2012 |

* cited by examiner

LIFTING ARM ASSEMBLY AND METHOD OF CHANGING A HOLDER IN SAID LIFTING ARM ASSEMBLY

CROSS REFERENCE TO PRIOR APPLICATIONS

This application is a U.S. National Phase application under 35 U.S.C. §371 of International Application No. PCT/IB2014/061906, filed on Jun. 3, 2014 and which claims benefit to Norwegian Patent Application No. 20130805, filed on Jun. 10, 2013. The International Application was published in English on Dec. 18, 2014 as WO 2014/199260 A2 under PCT Article 21(2).

FIELD

The present invention relates to a lifting arm assembly for lifting and/or moving pipes, and to a method for changing a holder arranged for connection to the lifting arm assembly.

BACKGROUND

A known problem in the field of pipe handling that it can be cumbersome to change the holder for gripper heads/gripping rollers on a lifting arm. Such operations are normally time-consuming as the holder and lifting arm are connected at several points, in addition to there being many parts that must be detached both in the right order and in the right direction in relation to each other. It can also be cumbersome to install a new holder because all the parts must be mounted in the right order and in the right direction in relation to each other. There may be several reasons for wanting to change the holder, for example, for general maintenance, if the holder is damaged in some way, or if another type of holder is required, etc.

Current systems require that the entire system must be replaced if, for example, a different work implement is required.

WO 2007/097698 describes an arrangement that can be used together with an excavator. The problem described is to find an easy way of integrating a take-up device between an upper fastening device connected to a lower working arm, and a lower fastening device connected to a work implement with a simultaneous transfer of a necessary pressure medium. Two tools are also shown, in the form of a digging bucket and a vibrator plate, where the tools have the same connection interface with the arm.

A disadvantage of the prior art is that it is difficult to change the work implement that is arranged in the holder because the work implement constitutes a compact part of larger systems and cannot be removed from the system without having to dismantle a plurality of parts.

SUMMARY

An aspect of the present invention is to remedy at least one of the disadvantages associated with the prior art. An aspect of the present invention is therefore to provide a simplified lifting arm assembly for changing a holder for gripper heads/gripping rollers on a lifting arm. A further aspect of the present invention is to provide a simplified system for changing tools, such as gripper heads/gripping rollers that are to be placed, or changed, on the holder.

In an embodiment, the present invention provides a lifting arm assembly for lifting an elongate element which includes a lifting arm comprising a complementary fastener and at least one fastening element, and a holder for at least one tool which comprises a first complementary fastening device. The holder is configured to be replaceable. The holder comprises a suspension device configured to fasten to the complementary fastener on the lifting arm, and at least one first receiving device configured to cooperate with the first complementary fastening device on the at least one tool.

BRIEF DESCRIPTION OF THE DRAWINGS

The present invention is described in greater detail below on the basis of embodiments and of the drawings in which.

DETAILED DESCRIPTION

Figure 1:
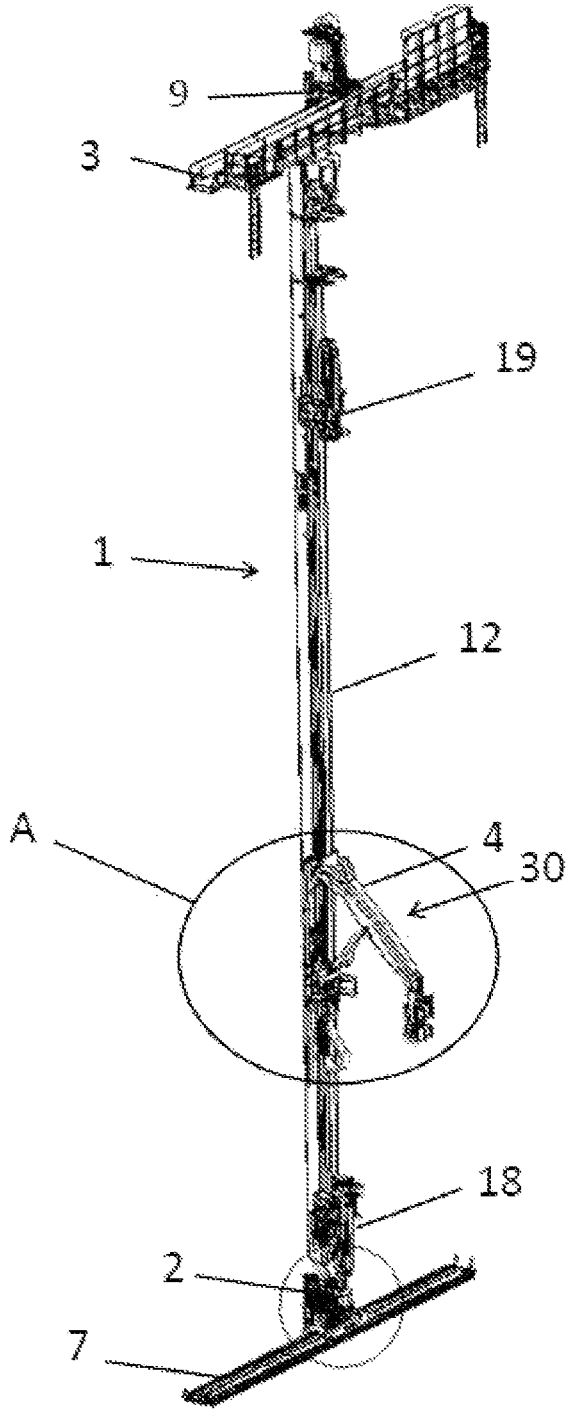
FIG. 1 shows a column machine to which a lifting arm assembly according to a first embodiment of the present invention is mounted.

The present invention relates to a lifting arm assembly for lifting elongate elements, comprising:

- a lifting arm; and
- a holder for at least one tool, the holder having a suspension device for fastening to a complementary fastener on the lifting arm, and at least a first receiving device for cooperation with a first complementary fastening device on the at least one tool.

The present invention simplifies the changing of the holder for gripper heads/gripping rollers when it is to be replaced by another holder.

The present invention further provides a simplified system for switching between gripper heads/gripping rollers that are adapted to pipes of different diameters, or switching between different gripper heads/gripping rollers if, for example, a gripper head is damaged. Modularity provides many options with regards to the pipe diameter to be handled, if it is desired to use one gripper head and one gripping roller, or two gripper heads, two gripping rollers etc. The present invention thus provides the gripper heads or gripping rollers as modular units which can easily be mounted in or removed from the holder. Today's solutions do not allow therefor because the gripper heads and gripping rollers are compact parts of larger systems that cannot simply be removed from the system.

In an embodiment of the present invention, the holder can, for example, have at least a second receiving device to cooperate with a second complementary fastening device on at least a second tool.

In an embodiment of the present invention, the at least first and second receiving devices can, for example, have the same configuration, and the at least first and second complementary fastening devices can, for example, have the same configuration.

In an embodiment of the present invention, the suspension device on the holder can, for example, comprise a split pin and at least one fastening hole adapted to receive the at least one fastening element.

In an embodiment of the present invention, the lifting arm can, for example, comprise a take-up device to take up the split pin in the suspension device on the holder. The take-up device can be C-shaped and can be adapted to receive the split pin so that the take-up device can rotate about the split pin.

The present invention further relates to a method for changing a holder arranged in connection with a lifting arm assembly, the method comprising the steps of:

disengaging two fastening elements from fastening holes, which fastening elements have the same center axis, by rotating a double-threaded screw that connects the two fastening elements;

removing the holder from the lifting arm;

positioning a holder for take-up of a transverse split pin arranged on the lifting arm, and screwing in the two fastening elements; and rotating the double-threaded screw to tighten the fastening elements.

In an embodiment of the present invention, the lifting arm assembly can, for example, comprise a heavy lift tool to avoid damage to pipes from clamping. This relates in particular to drill collars that are much heavier than normal drill pipes. Heavier pipes, such as drill collars, do not have the same outer diameter along their whole length, i.e., there is a part of the pipe that has larger diameter than the rest of the pipe. The heavy lift tool may be configured with a collar on which the part of the pipe with larger diameter rests. A gripping via clamping of the drill collar is thereby avoided, and thereby also the danger that the pipe can be damaged. The heavy lift tool is composed of a plurality of parts and is, in an embodiment, configured with a plate that has a semi-circular form having a larger diameter than a drill pipe, but a smaller diameter than the largest diameter of a drill collar. Pipes can be "locked in place", i.e., the pipes are embraced to allow the pipe to move freely in the vertical direction, but not in the horizontal direction, in the heavy lift tool in that the plate has a smaller opening than the diameter of the pipe resting on the collar in the plate. A second hindrance to a horizontal movement of the pipe can be produced by tilting down two tilting devices arranged at an outer end of the tool. In the inactive position, the two tilting devices are arranged in a position that does not affect other operations, and the plate is retracted into the tool so that it is not in the way of other operations. In the active position, the plate is run forwards, for example, by using hydraulic cylinders or other solutions into its working position where it is ready to receive the drill collar. When the drill collar rests against the plate, the two tilting devices can be tilted into a position that prevents the pipe from falling or sliding out horizontally from the heavy lift tool.

The heavy lift tool is primarily to lift the heaviest stands/pipe joints (1 stand=3-4 assembled drill pipes, ~27-40 meters total length). However, it can also be used to lift all pipes that have a shoulder under which to lift. All types of drill pipe and drill collars have such a shoulder so that the heavy lift tool can be used provided there is a plate with a collar for the pipe dimensions that are to be used on the rig in question. The plate can easily be changed depending on the diameter of the pipe to be lifted.

A non-limiting embodiment of the present invention will now be described with reference to the attached drawings in which like parts have been given like reference numerals.

FIG. 1 shows a part of a column machine 1 to which a lifting arm assembly 30 according to a first embodiment of the present invention is mounted.

The column machine 1 comprises a lower carriage 2 that is arranged for movement along a toothed rack 7 on a deck. A column 12 extends from the lower carriage 2 up to an upper carriage 9, which upper carriage 9 is arranged at the upper end of the column machine 1 and can be moved along an upper rail 3. The upper rail 3 may, for example, be fastened to a drilling derrick (not shown). The column machine 1, including the upper carriage 9 and the lower carriage 2, can thereby be moved parallel to a deck. The column machine 1 is further shown with a lifting arm assembly 30 that can be moved up and down along the column 12 and extended out at a variable distance relative to the longitudinal axis of the column 12. The lifting arm assembly 30 is normally used in connection with the handling of pipes. An upper guide arm 19 and a lower guide arm 18 are also shown above and below the lifting arm assembly 30. The upper guide arm 18 and the lower guide arm 19 are illustrated in a retracted position.

Figure 2:
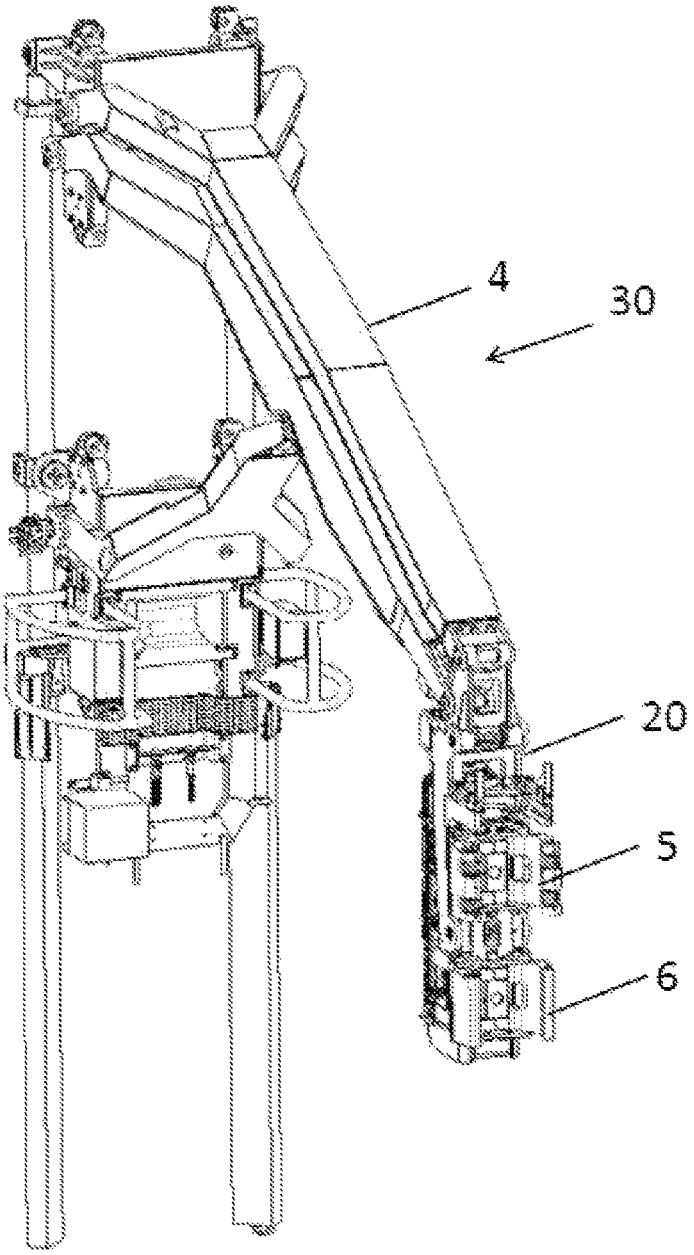
FIG. 2 shows details of section A in FIG. 1.

FIG. 2 shows details of section A in FIG. 1 with a lifting arm assembly 30. The lifting arm assembly 30 comprises a lifting arm 4, a holder 20 connected to the lifting arm 4, and two tools 5, 6 in the form of gripping roller 5 and a gripping clamp 6 fastened to the holder 20.

Figure 3:
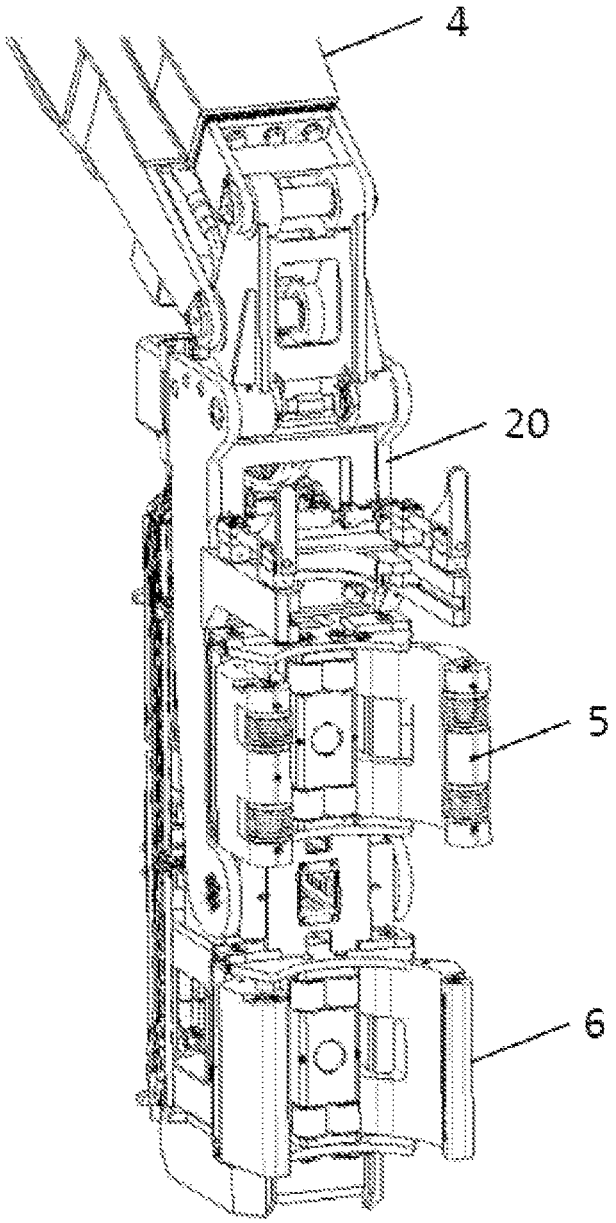
FIG. 3 shows details around a holder connected to a lifting arm and two tools.

FIG. 3 shows more details around the holder 20 and its attachment to the lifting arm 4 and the tools 5, 6, respectively.

Figure 4:
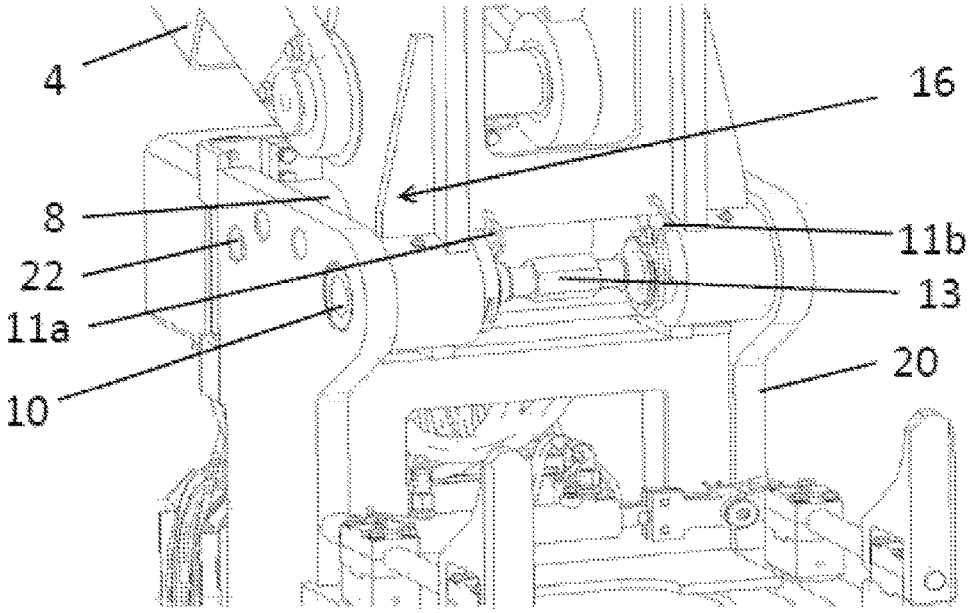
FIG. 4 shows a more detailed sectional view of the connection between the lifting arm and the holder.

FIG. 4 shows a more detailed sectional view of the connection between the lifting arm 4 and the holder 20. The holder 20 has a first and second receiving device 14 (see FIG. 6) for cooperation with a first and second complementary fastening device on a second tool 5, 6. The first and second receiving devices 14 may have the same configuration. The at least first and second complementary fastening devices may also have the same configuration.

A suspension device 15 can comprise first and second locking washers 11*a*, 11*b* that provide that fastening elements 10 do not become inadvertently unscrewed from the double-threaded screw 13.

The complementary fastener 16 on the lifting arm 4 comprises a take-up device 8 for taking up a transverse split pin 22 in the suspension device 15 on the holder 20. The take-up device 8 may be C-shaped. The split pin 22 is arranged to be receivable inside the take-up device 8.

The holder 20 is configured with the suspension device 15 (details in FIG. 10) to fasten to a complementary fastener 16 on the lifting arm 4. The suspension device 15 comprises the split pin 22 and at least one fastening hole 23*a*, 23*b* adapted to receive two fastening elements 10, for example, bolts, screws pins, sleeves etc. A double-threaded screw 13 is also shown. In alternative embodiments, the double-threaded screw 13 may be a nut, sleeve, hydraulic cylinder etc. The double-threaded screw 13 is so configured that it has right-handed threads on one side and left-handed threads on the other. The double-threaded screw 13 lies on the same longitudinal axis as the two fastening elements 10 so that the fastening elements 10 are simultaneously screwed in or out from their respective side of the double-threaded screw 13 by rotation of the double-threaded screw 13. The fastening elements 10 are supported towards the center of the double-threaded screw 13 in an unlocked position (see FIG. 8), while in a locked position (see FIG. 9) they are screwed out of the center and into the fastening holes 23*a*, 23*b*.

Figure 5:
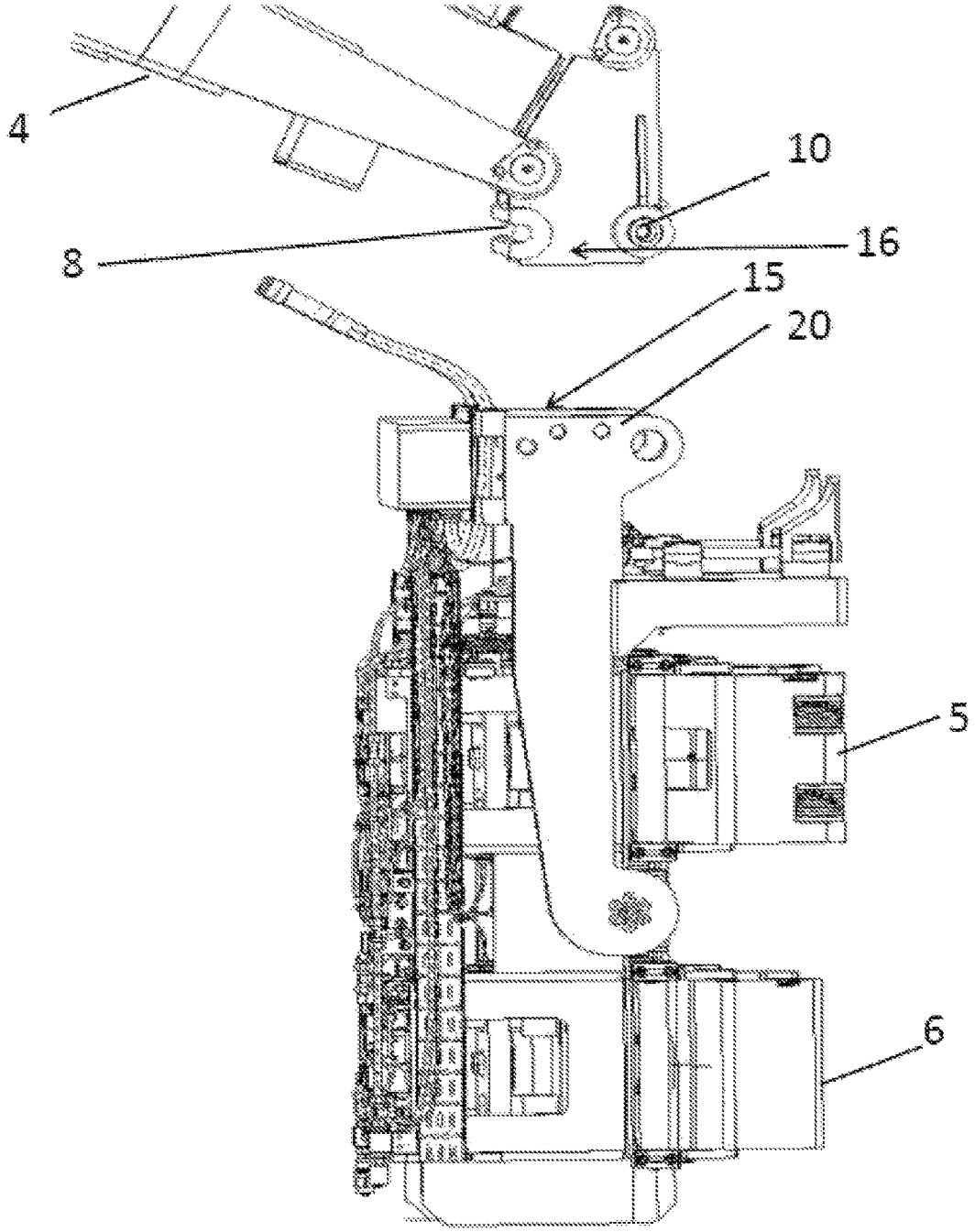
FIG. 5 shows a first sectional view showing the changing of the holder on the lifting arm.
Figure 6:
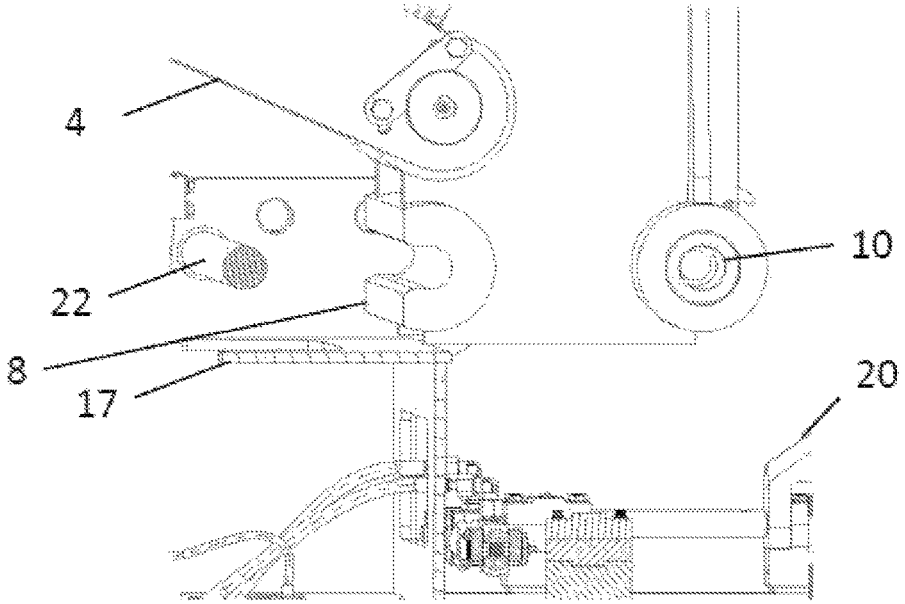
FIG. 6 shows a second sectional view showing the changing of the holder on the lifting arm.

FIGS. 5 to 9 are sequential sectional drawings showing the changing of the holder 20 on the lifting arm 4, where the different sequences will be explained in more detail below. FIG. 5 shows the holder completely separate from the lifting arm 4. During mounting, the holder 20 and the lifting arm 4 are moved towards each other, as can be seen in FIG. 6.

Figure 7:
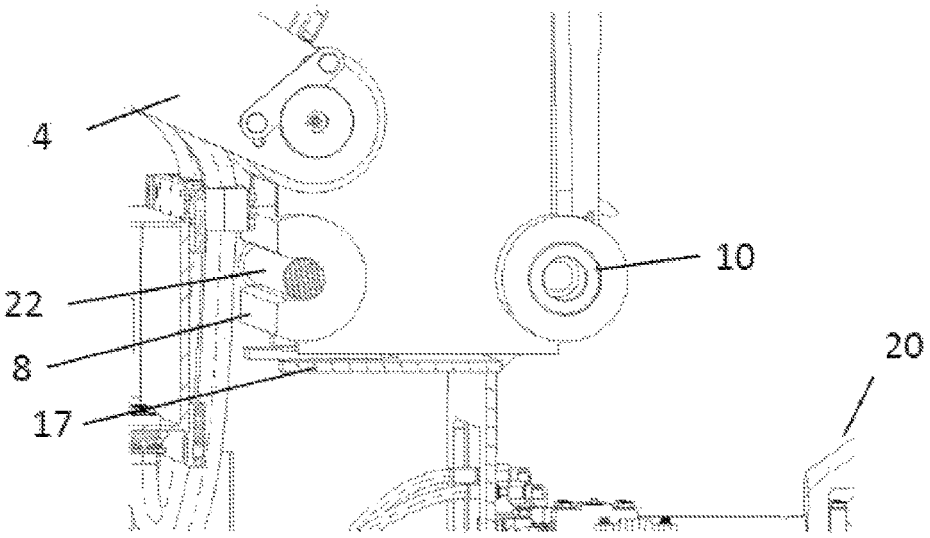
FIG. 7 shows a third sectional view showing the changing of the holder on the lifting arm.
Figure 8:
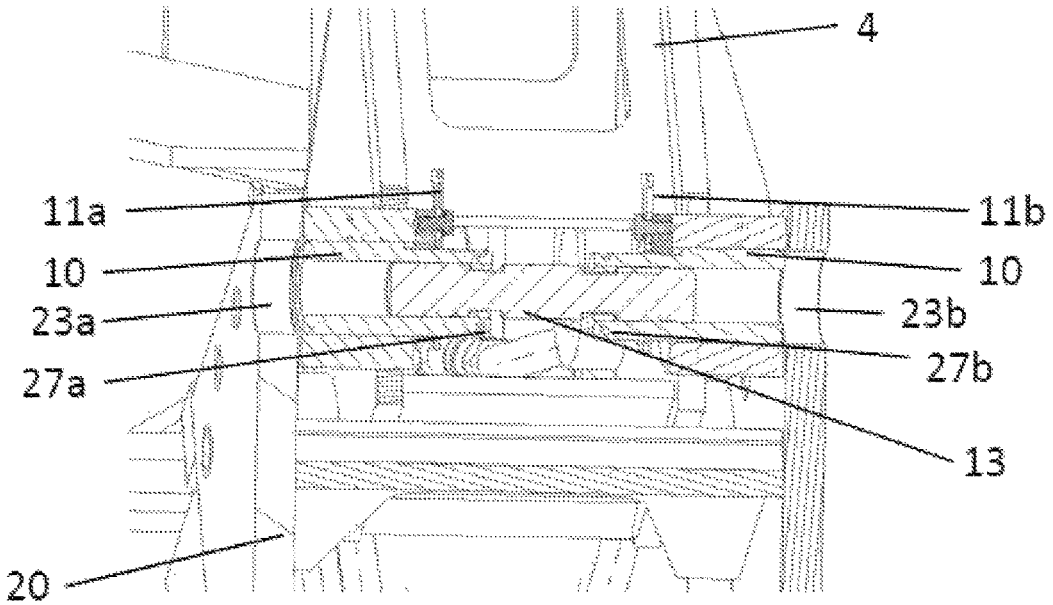
FIG. 8 shows a fourth sectional view showing the changing of the holder on the lifting arm.

The suspension device 15 on the holder is configured with a split pin 22 (retaining pin), and a stop plate 17 against which a complementary fastener on the lifting arm 4 will rest during assembly of the holder 20 to the lifting arm 4. When the lifting arm 4 has been lowered down to the stop plate 17, the lifting arm 4 is moved backwards along the stop plate 17, towards the split pin 22 that it will automatically meet because of the guiding via the stop plate (see FIG. 6). When the lifting arm 4 has been moved into engagement with the split pin 22, the fastening holes 23*a*, 23*b* will be aligned with the fastening elements 10. This situation is shown in FIGS. 7 and 8.

Figure 9:
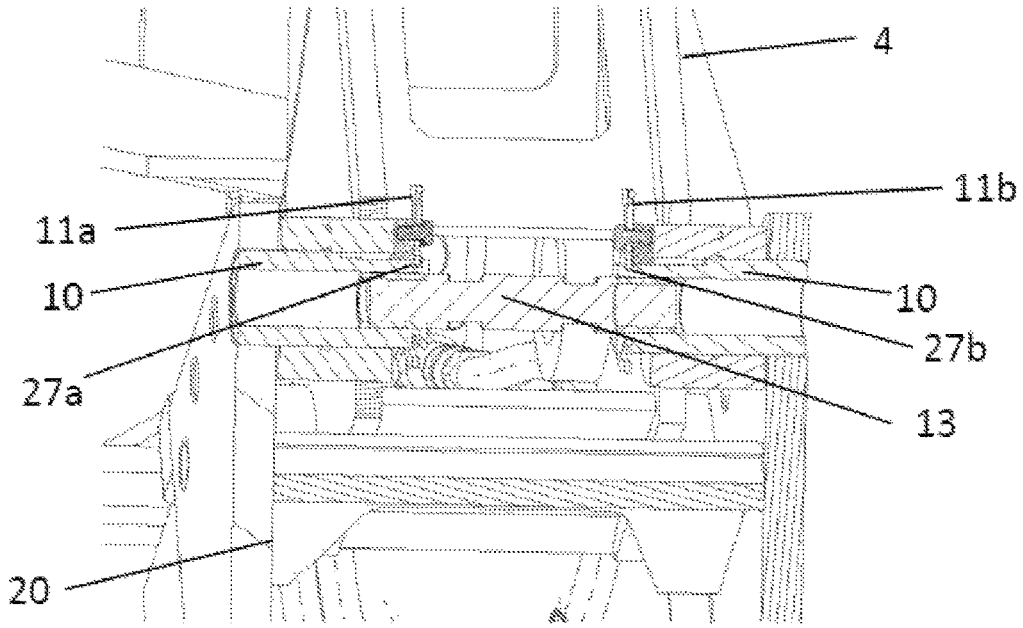
FIG. 9 shows a fifth sectional view showing the changing of the holder on the lifting arm.
Figure 10:
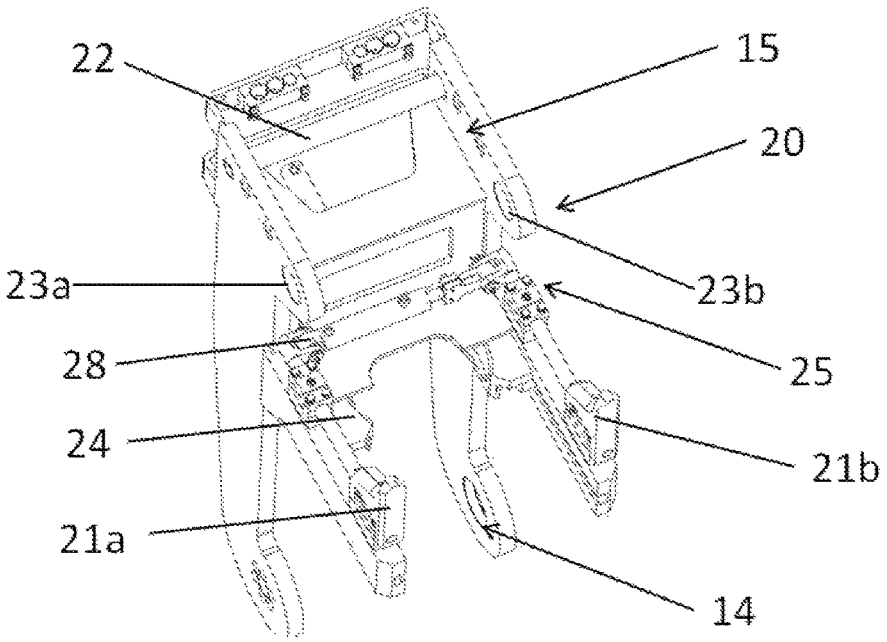
FIG. 10 shows an embodiment of the holder with a heavy lift tool in an inactive position.

The fastening elements 10 will, on rotation of the double-threaded screw 13, now be capable of being unscrewed from the fastening holes 23*a*, 23*b*. When the fastening elements 10 have been unscrewed from the fastening holes 23*a*, 23*b* (see FIG. 9), the first locking washer 11*a* and the second locking washer 11*b* will be arranged in locking grooves 27*a*, 27*b* in the fastening elements 10 and provide that the fastening elements 10 do not inadvertently become unscrewed from the double-threaded screw 13. FIG. 9 shows the locking washers 11*a*, 11*b* being arranged in the locking grooves 27*a*, 27*b*.

FIGS. 10-13 show an embodiment of the holder 20 with a heavy lift tool 25 in an inactive position (FIG. 10), and in an active position (FIG. 11), respectively. The heavy lift tool 25 is used to avoid damage to pipes from clamping. It should be understood that the holder will normally also comprise tools 5, 6, but that these parts have been removed to clearly illustrate the principle of the heavy lift tool 25. Heavier pipes, such as, for example, drill collars, do not have the same outer diameter along the whole length of the pipe, i.e., there is a part of the pipe that has larger diameter than the rest of the pipe. The heavy lift tool 25 is configured with a collar 26 on which the part of the drill collar with larger diameter rests. See in particular FIG. 12 where a drill collar rests on the collar 26 of the heavy lift tool 25. The heavy lift tool 25 is shown with a plate 24 having a semi-circular form that has larger diameter than a drill pipe, but a smaller diameter than a drill collar, in which the drill collar is placed. The plate 24 surrounds more than half the circumference of the part of the drill collar of larger diameter. The drill collar will therefore not be able to slip out of the opening in the plate 24. To be able to remove a drill collar that is arranged with its larger diameter in the plate 24, a lower end of the drill collar must be landed on deck and the lifting arm 4 must be lowered so that the top of the plate 24 comes into the area of the drill collar of smaller diameter. It is only then that the drill collar can be taken out of the heavy lift tool 24.

The drill collar with a smaller diameter over a part of its length can be "locked in place", i.e., the pipes are embraced to allow the pipe to move freely in the vertical direction, but not in the horizontal direction, in the heavy lift tool 25 by remote control by tilting down the tilting devices 21*a*, 21*b* arranged at an outer end of the heavy lift tool 25 through manipulation of a cylinder 28 arranged at the opposite end of the tilting devices 21*a*, 21*b*. The tilting devices 21*a*, 21*b* can function as a second hindrance in that they close the opening so that the pipe cannot fall out horizontally from the heavy lift tool 25. When the heavy lift tool 25 is used to lift single drill collars (~9 meters long), for example, when making up stands, the heavy lifting tool 25 lifts under a shoulder that is arranged close to an upper end of the drill collar. Lifting at the top end is done when making up pipe joints or stands (3-4 single pipes=a stand). So-called "tripping" is done by moving whole stands to and from the well. Lifting is done closer to the center of the stand, and because a stand is now being lifted, it is possible to hold around the stand at the top and the bottom with the aid of the lower guide arm 18 and the upper guide arm 19 (FIG. 1), thereby allowing the whole stand to be safely lifted and moved.

Figure 11:
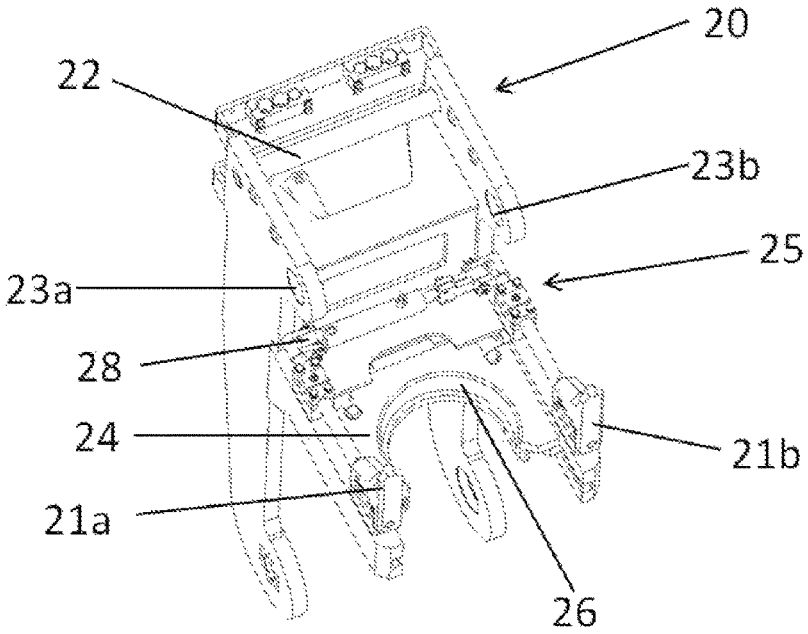
FIG. 11 shows an embodiment of the holder with a heavy lift tool in an active position.
Figure 12:
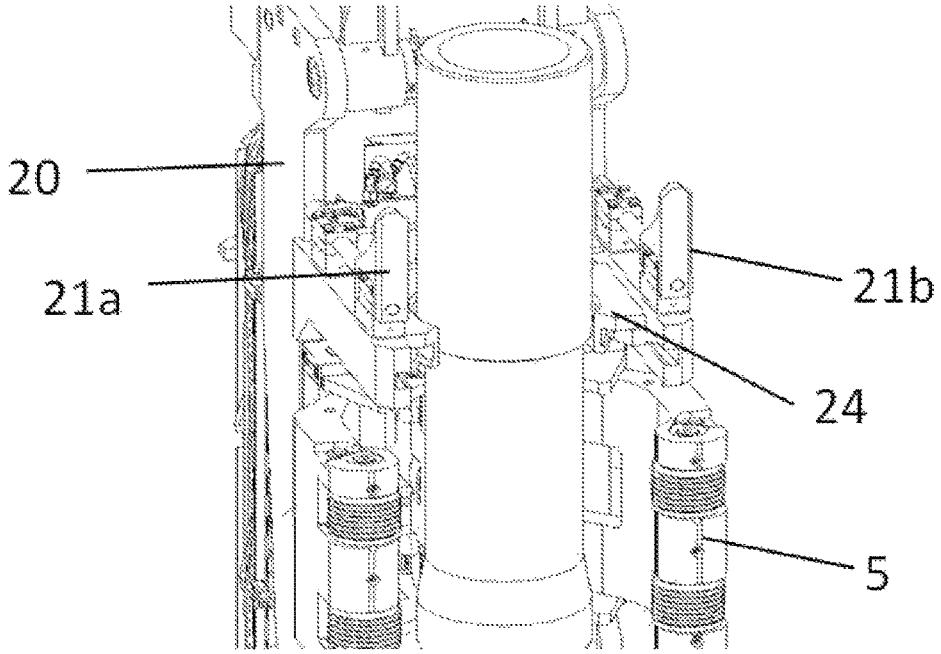
FIG. 12 shows an embodiment of the holder with a drill collar placed in the heavy lift tool, and where two tilting devices lock a pipe in the heavy lift tool.
Figure 13:
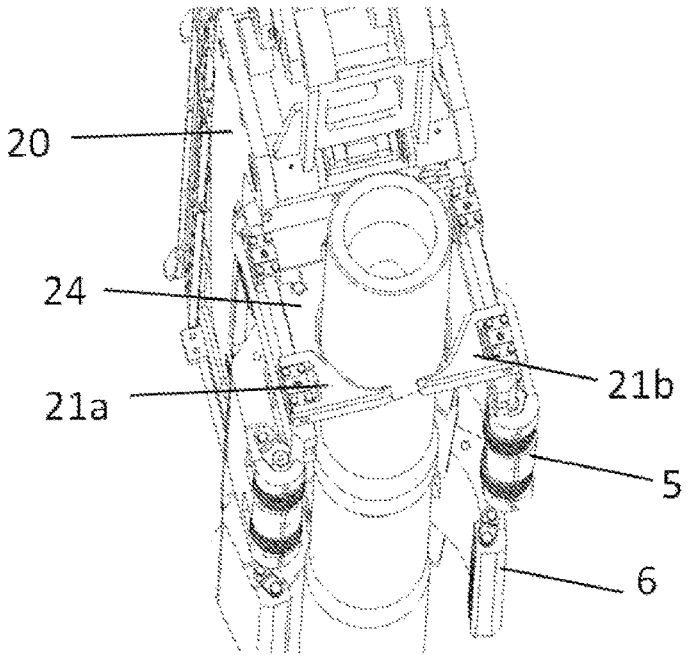
FIG. 13 shows an embodiment of the holder with a drill collar placed in the heavy lift tool, and where two tilting devices lock a pipe in the heavy lift tool.

In the inactive position, the two tilting devices 21*a*, 21*b* are arranged in a position that does not affect other operations, and the plate 24 is retracted so that it is not in the way of other operations. In the active position, the plate 24 is moved forwards, for example, by use of hydraulic cylinders or other solutions, into its active position in which it is ready to receive the drill collar. When the pipe rests against the plate 24, the two tilting devices 21*a*, 21*b* are tilted into a position that prevents the pipe from falling or sliding out of the heavy lift tool 25 horizontally. FIG. 11 shows the tilting devices 21*a*, 21*b* still in their inactive position, but it should be understood that after a pipe has been placed against the plate 24, the tilting devices 21*a*, 21*b* will be tilted down and "lock the pipe in place" in the heavy lift tool 25, or, to be more specific, allow a vertical movement of the pipe, but not a horizontal movement of the pipe.

Figure 14:
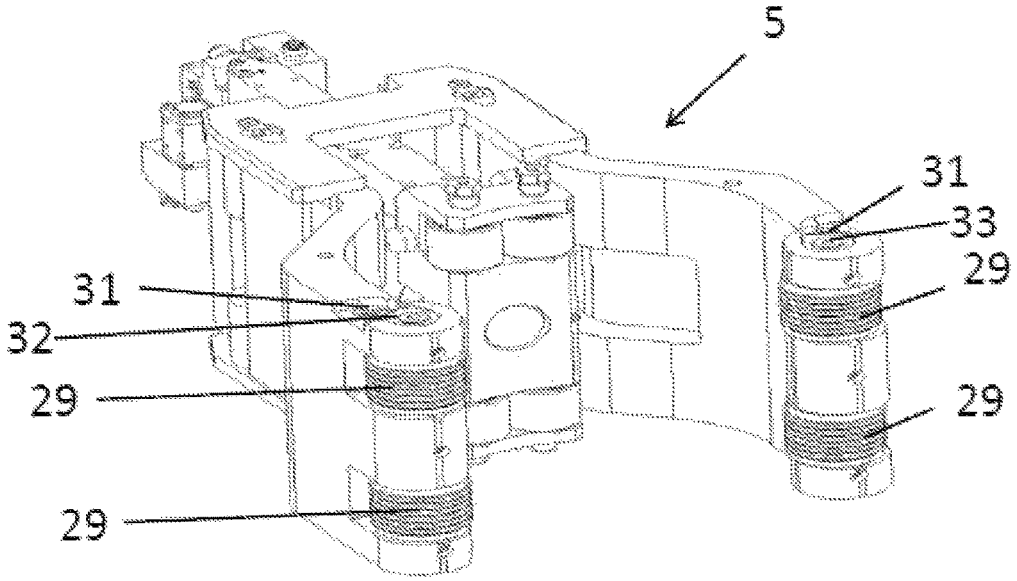
FIG. 14 shows a perspective sectional view of a tool exemplified by a gripping roller.
Figure 15:
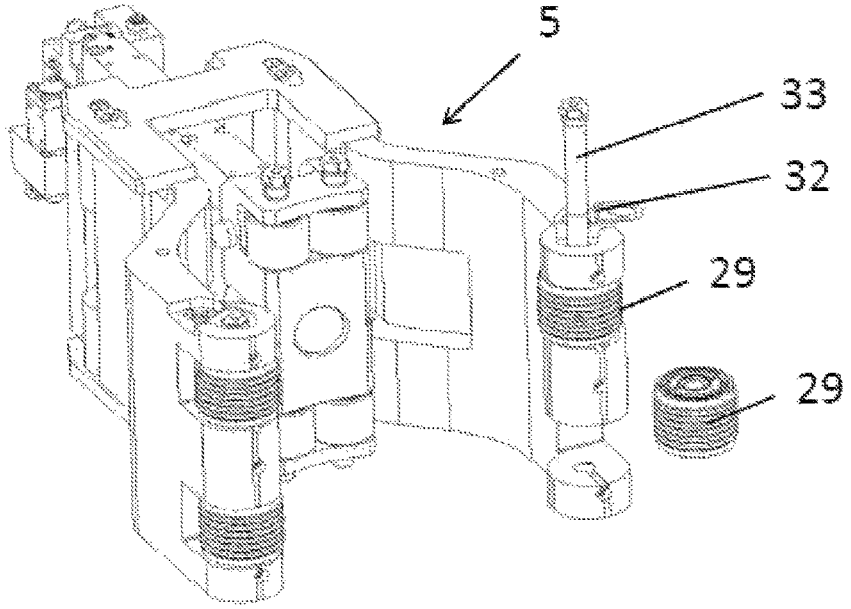
FIG. 15 shows a perspective sectional view of a tool exemplified by a gripping roller.

FIGS. 14 and 15 show a perspective sectional view of a tool exemplified by a gripping roller 29. The gripping rollers 29 can easily be changed by first loosening a locking screw 31 which releases a locking washer 32. The locking washer 32 can then be turned to gain access to a pin 33. By unscrewing and removing the pin 33, the gripping rollers 29 are released and the one or ones that must be replaced can easily be changed. The above method is reversed for mounting.

In use, the present invention describes a method for changing a holder 20 arranged in connection with a lifting arm assembly 30. This is done by loosening two fastening elements 10 from fastening holes 23*a*, 23*b* by rotating the double-threaded screw 13 that is common for the two fastening elements 10. The holder 20 is thereby released from the lifting arm 4 so that it can be removed and replaced with another holder 20 that is positioned for take-up of the transverse split pin 22 arranged as a part of the complementary fastener 16 of the lifting arm 4. The holder 20 is further positioned so that the two fastening elements 10 can be screwed into the fastening holes 23*a*, 23*b*. The double-threaded screw 12 is then rotated to tighten the fastening elements 10.

By using the above-described embodiment, the object of the present invention is achieved, namely to provide a simplified assembly to change a holder for gripper heads/gripping rollers on a lifting arm, and to provide a simplified system for changing tools, such as gripper heads/gripping rollers that are to be placed, or changed, on the holder, and a method for doing so.

The embodiment described herein is merely intended for illustrative purposes and should by no means be regarded as limiting. A person of skill in the art could make modifications or changes to the present invention without departing from the scope of the present invention, as defined in the attached claims.

The invention claimed is:

1. A lifting arm assembly for lifting an elongate element, the lifting arm assembly comprising:

a lifting arm comprising a complementary fastener and at least one fastening element; and a holder for at least one tool which comprises a first complementary fastening device, the holder being configured to be replaceable and comprising, a suspension device configured to fasten to the complementary fastener on the lifting arm, and at least one first receiving device configured to cooperate with the first complementary fastening device on the at least one tool, wherein, the at least one tool comprises at least one second tool comprising a second complementary fastening device, and the holder further comprises at least one second receiving device configured to cooperate with the second complementary fastening device on the at least one second tool.

2. The lifting arm assembly as recited in claim 1, wherein the at least one first receiving device and the at least one second receiving device have a same configuration, and the first complementary fastening device and the second complementary fastening device have the same configuration.

3. The lifting arm assembly as recited in claim 1, wherein the suspension device comprises a split pin and at least one fastening hole, and at least one fastening hole being configured to receive the at least one fastening element.

4. The lifting arm assembly as recited in claim 3, wherein the lifting arm further comprises a take-up device configured to take up the split pin of the suspension device on the holder.

5. The lifting arm assembly as recited in claim 1, wherein the holder further comprises a heavy lift tool configured to lift a drill collar.

6. The lifting arm assembly as recited in claim 5, wherein the heavy lift tool comprises a displaceable plate comprising a collar, and tilting devices configured to lock the drill collar in the heavy lift tool.

7. A lifting arm assembly for lifting an elongate element, the lifting arm assembly comprising:

a lifting arm comprising a complementary fastener and at least one fastening element; and a holder for at least one tool which comprises a first complementary fastening device, the holder being configured to be replaceable and comprising, a suspension device configured to fasten to the complementary fastener on the lifting arm, and at least one first receiving device configured to cooperate with the first complementary fastening device on the at least one tool, wherein, the suspension device comprises a split pin and at least one fastening hole, and at least one fastening hole being configured to receive the at least one fastening element.

8. The lifting arm assembly as recited in claim 7, wherein, the at least one tool comprises at least one second tool comprising a second complementary fastening device, and the holder further comprises at least one second receiving device configured to cooperate with the second complementary fastening device on the at least one second tool.

9. The lifting arm assembly as recited in claim 8, wherein the at least one first receiving device and the at least one second receiving device have a same configuration, and the first complementary fastening device and the second complementary fastening device have the same configuration.

10. The lifting arm assembly as recited in claim 7, wherein the lifting arm further comprises a take-up device configured to take up the split pin of the suspension device on the holder.

11. The lifting arm assembly as recited in claim 7, wherein the holder further comprises a heavy lift tool configured to lift a drill collar.

12. The lifting arm assembly as recited in claim 11, wherein the heavy lift tool comprises a displaceable plate comprising a collar, and tilting devices configured to lock the drill collar in the heavy lift tool.

13. A lifting arm assembly for lifting an elongate element, the lifting arm assembly comprising:

a lifting arm comprising a complementary fastener and at least one fastening element; and a holder for at least one tool which comprises a first complementary fastening device, the holder being configured to be replaceable and comprising, a suspension device configured to fasten to the complementary fastener on the lifting arm, and at least one first receiving device configured to cooperate with the first complementary fastening device on the at least one tool, wherein, the holder further comprises a heavy lift tool configured to lift a drill collar.

14. The lifting arm assembly as recited in claim 13, wherein, the at least one tool comprises at least one second tool comprising a second complementary fastening device, and the holder further comprises at least one second receiving device configured to cooperate with the second complementary fastening device on the at least one second tool.

15. The lifting arm assembly as recited in claim 14, wherein the at least one first receiving device and the at least one second receiving device have a same configuration, and the first complementary fastening device and the second complementary fastening device have the same configuration.

16. The lifting arm assembly as recited in claim 13, wherein the suspension device comprises a split pin and at least one fastening hole, and at least one fastening hole being configured to receive the at least one fastening element.

17. The lifting arm assembly as recited in claim 16, wherein the lifting arm further comprises a take-up device configured to take up the split pin of the suspension device on the holder.

18. The lifting arm assembly as recited in claim 13, wherein the heavy lift tool comprises a displaceable plate comprising a collar, and tilting devices configured to lock the drill collar in the heavy lift tool.

* * * * *